United States Patent [19]

Sanchez

[11] Patent Number: 4,910,915

[45] Date of Patent: Mar. 27, 1990

[54] SINGLE KEY MULTIPLE LOCKING SYSTEM

[76] Inventor: Raynerio Sanchez, 315 Oser Ave., Hauppauge, N.Y. 11788

[21] Appl. No.: 396,085

[22] Filed: Aug. 21, 1989

[51] Int. Cl.[4] ..... E05F 7/02

[52] U.S. Cl. ..... 49/255; 292/304; 70/134; 312/138.1

[58] Field of Search ..... 292/304; 70/134; 49/158, 159, 160, 255, 254, 256; 312/138.1, 222

[56] References Cited

U.S. PATENT DOCUMENTS

| | | | |
|---|---|---|---|
| 12,405 | 11/1905 | Giescy . | |
| 756,006 | 3/1904 | Essig . | |
| 820,027 | 5/1906 | Tabor . | |
| 1,166,550 | 1/1916 | Shirley et al. . | |
| 1,727,877 | 9/1929 | Gelbaugh | 49/255 |
| 1,770,571 | 7/1930 | Donnelly | 49/255 |

*Primary Examiner*—Kenneth J. Dorner
*Assistant Examiner*—Gerald A. Anderson
*Attorney, Agent, or Firm*—Leonard Belkin

[57] ABSTRACT

A single key multi locking system for a display case for jewelry and other items to be displayed comprising a housing with transparent flat walls for containing a stand for display. A door hinged along one edge forms one of the walls of the housing. The housing is provided with upper and lower door jambs against which the door is closed. The upper door jamb has a projection spaced away from it a sufficient distance to accomodate the thickness of the door. The lower door jamb is provided with a ledge on the inside of the housing. The door is provided with a lock having a tongue on the inside to raise the door when the tongue is turned down behind the lower jamb and comes in contact with the ledge. With the use of a single lock and key the door is locked top and bottom with a single turn of the key, the upper edge of the door being wedged between the projection and the upper jamb in the locking position. When the door is unlocked the tongue is placed in a horizontal position permitting the door to drop and the tongue is able to clear the lower jamb thereby permitting the door to be opened. Multiple engagement may be provided along both vertical edges of the door.

10 Claims, 4 Drawing Sheets

FIG. 1
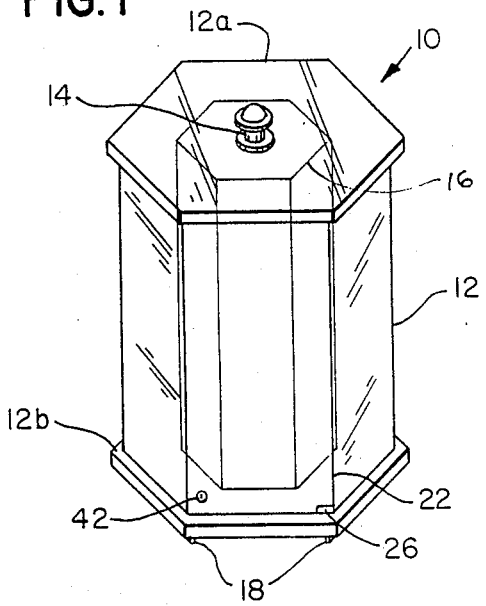
FIG. 2
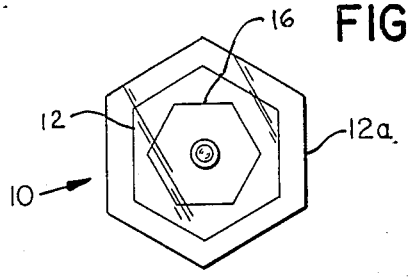
FIG. 3
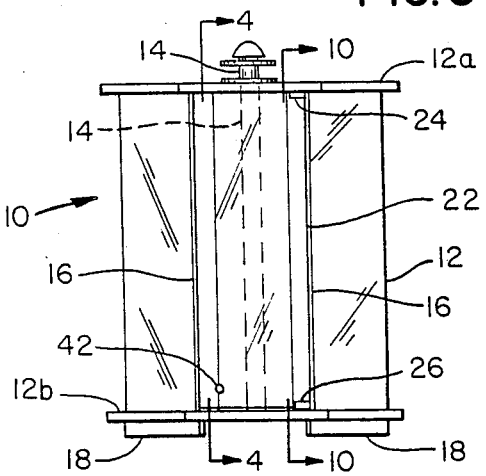
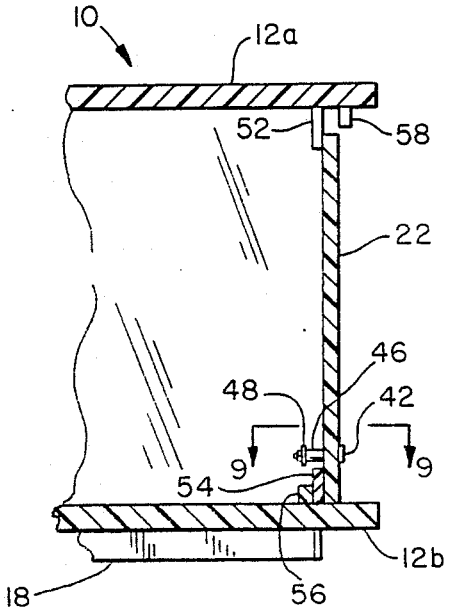
FIG. 4
FIG. 8
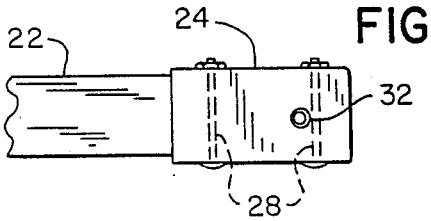
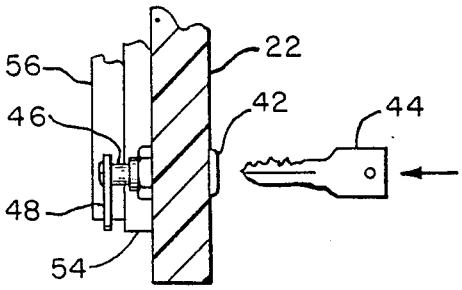
FIG. 9

FIG. 5
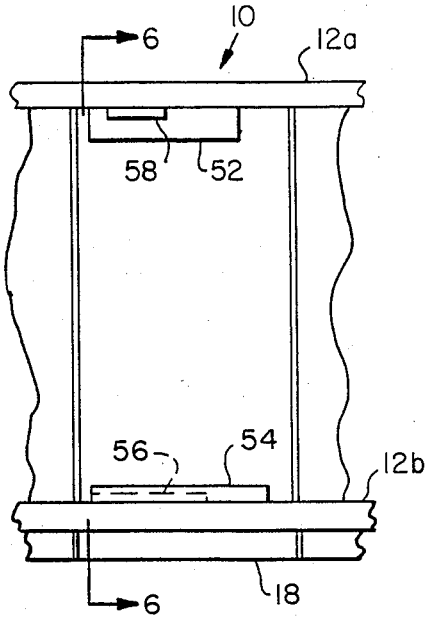
FIG. 6
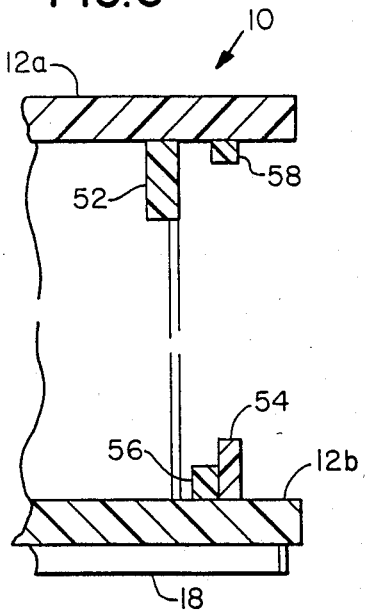
FIG. 7
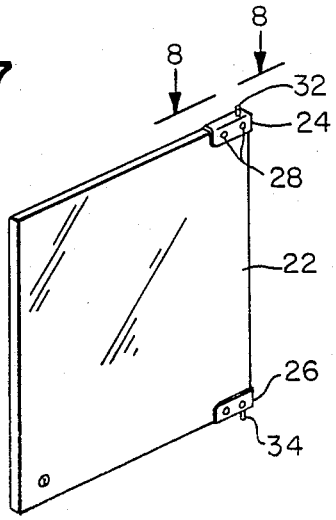
FIG. 10
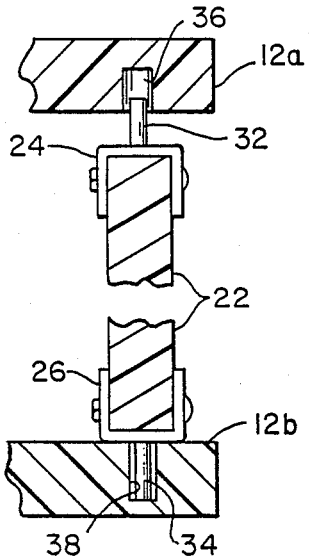
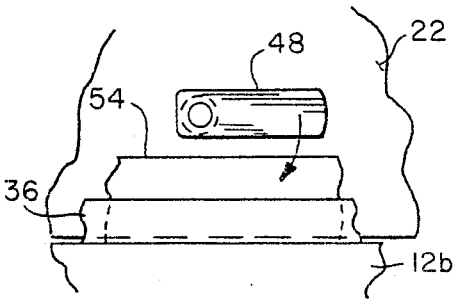
FIG. 13
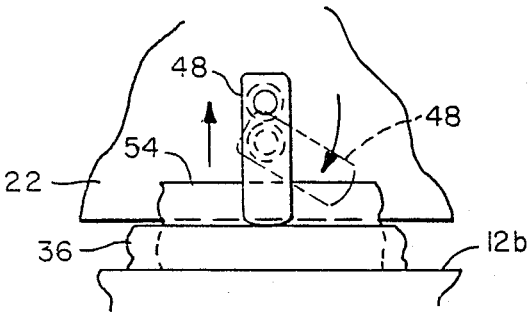
FIG. 14

FIG. 11A
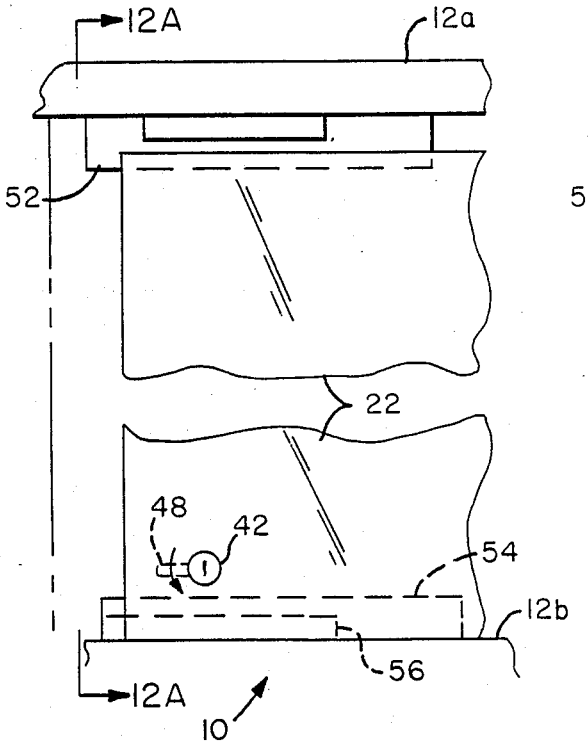
FIG. 11B
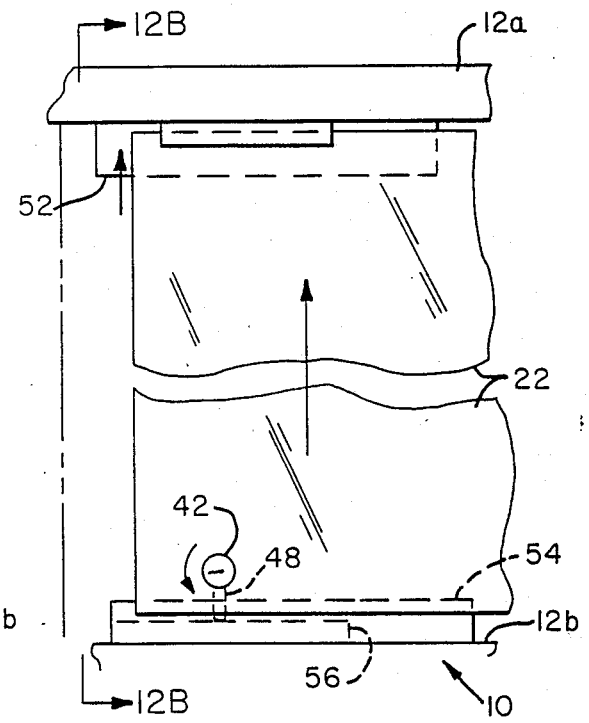
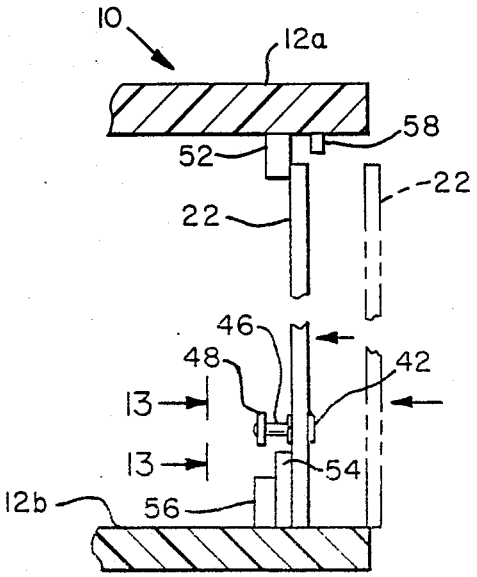
FIG. 12A
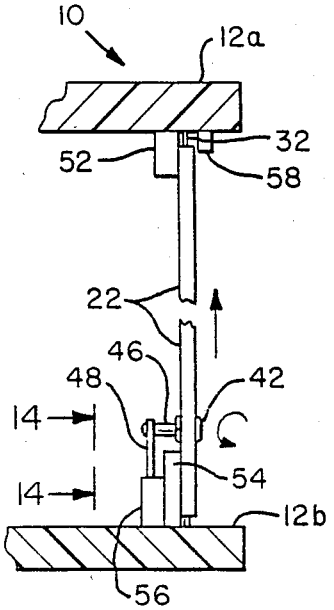
FIG. 12B

SINGLE KEY MULTIPLE LOCKING SYSTEM

BACKGROUND OF THE INVENTION

The present invention relates to a single key multiple locking system and more particularly to a locking system for securing a jewelry case against unauthorized entry.

Jewelry display cases are usually kept locked to prevent theft of the contents. The problem is particularly acute where the case is located for maximum exposure but at the same time is under a minimum of surveillance.

The use of a single lock is usually not sufficient to make such a case free of tampering which could result in the theft of the contents. Typically, the entry door to such a jewelry case is provided with two or more locks to insure that there is no place where the door can be pried open just enough to permit some of the contents to be pilfered.

The use of multiple locks not only increases the costs of such cases but in addition makes it more time consuming for the sales person to unlock and lock the case when access is required.

The following U.S. Pat. Nos. show devices for securing closures: 12,405, 756,006, 820,027, and 1,166,550. All of these patents relate to window locks and none teaches the present invention.

SUMMARY OF THE INVENTION

This invention provides a locking system for a display case suitable for use with jewelry incorporating a single key lock which will simultaneously form two or more locking engagements on a door in the display case resulting in the door being incapable of being pried open enough to permit pilferage of any of the contents.

A preferred embodiment of this invention incorporates a key lock with a tongue which when rotated into a locking position simultaneously raises the door to interlock in one or more other locations so as to make the door incapable of being pried open at any point along its periphery. When the key is employed to unlock the door, the tongue is rotated to permit the door to return to a position where the door can be opened in normal fashion.

This invention may have application for use in housings other than jewelry cases such as display cases for tools and other merchandise to be displayed.

It is thus a principal object of this invention to provide a tamper proof access to a display case.

Other objects and advantages of this invention will hereinafter become obvious from the following detailed description of preferred embodiments of this invention.

BRIEF DESCRIPTION OF THE DRAWINGS

FIG. 1 is an isometric view of a display case incorporating a preferred embodiment of the invention.

FIG. 2 is a top view of the case shown in FIG. 1.

FIG. 3 is a front elevation view of the case of FIG. 1.

FIG. 4 is a section view along 4—4 of FIG. 3.

FIG. 5 is a front elevational view of a portion of the case shown in FIG. 3 with the door removed.

FIG. 6 is a section view taken along 6—6 of FIG. 5.

FIG. 7 an isometric view of the door used in the display case shown in the previous figures.

FIG. 8 is a view along 8—8 of FIG. 7.

FIG. 9 is a section view taken along 9—9 of FIG. 4.

FIG. 10 is a section view taken along 10—10 of FIG. 3.

FIGS. 11A and 11B are front elevational views of the door and portions of the case showing movement between the unlocked and locked positions, respectively.

FIGS. 12A and 12B are views taken along 12A—12A and 12B—12B of FIGS. 11A and 11B, respectively.

FIG. 13 is a view taken along 13—13 of FIG. 12A.

FIG. 14 is a view taken along 14—14 of FIG. 12B.

DETAILED DESCRIPTION OF THE PREFERRED EMBODIMENTS

Figure 15:
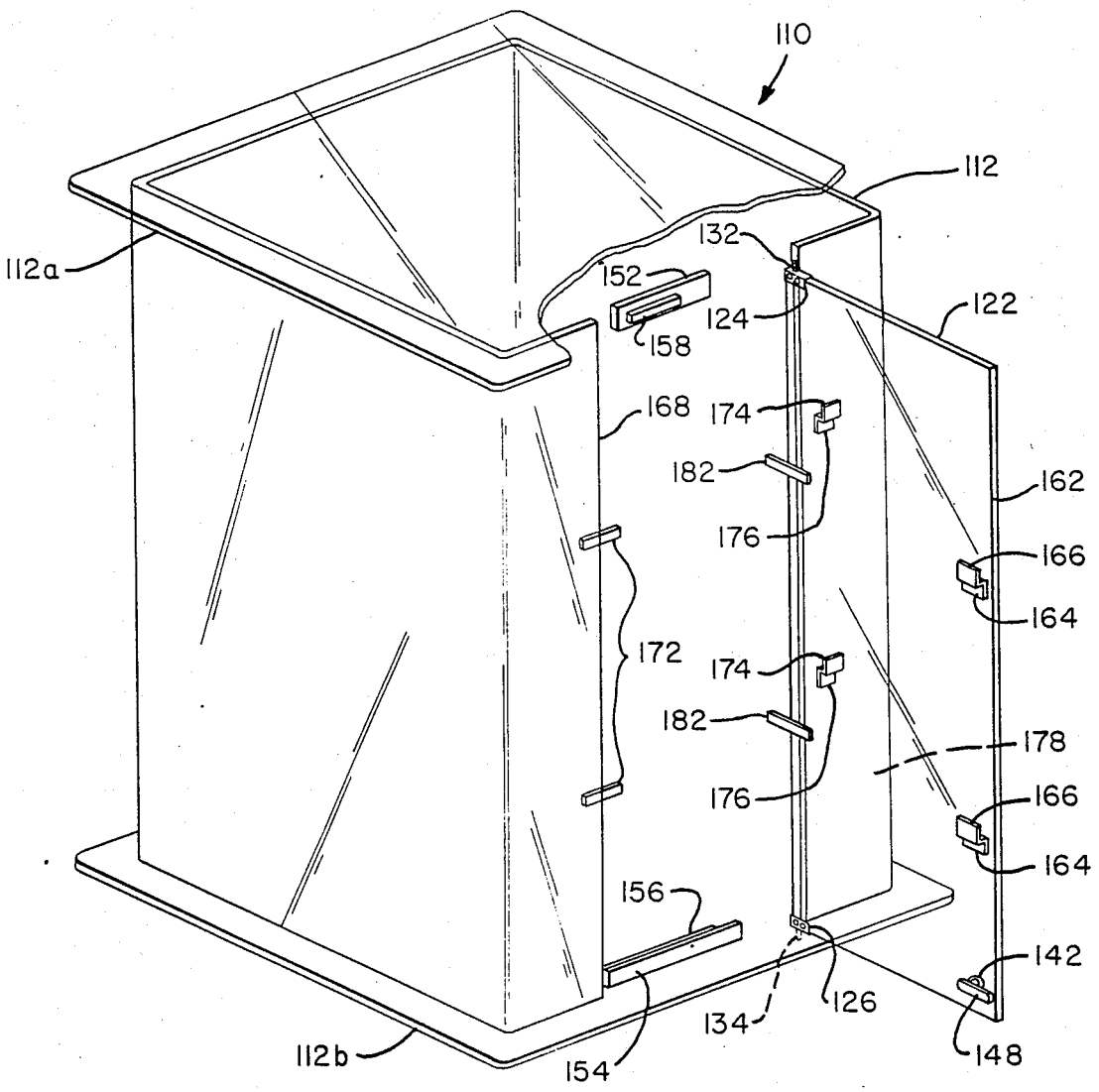
FIG. 15 is an isometric view of an alternative embodiment with the top removed.

Referring to FIGS. 1, 2, and 3, there is illustrated display case 10 consisting of a housing 12 which is a hexagon in shape with six flat sides made of a suitable transparent material such as lucite mounted for rotation on a shaft 14. Housing 12 is provided with an overhanging roof **12*a* and an overlapping floor 12*b*** as illustrated.

Within housing 12 shown in phantom is a structure 16 for the mounting of display items such as items of jewelry. Shaft 14 is supported by a base or pedestal 18 so that housing 12 may be rotated about base 18 permitting convenient perusal by potential customers of all of the items of jewelry mounted therein without the presence of a sales person.

Housing 12 is provided with a door 22 forming one side of the hexagon to permit access to the interior of housing 12. As seen in FIG. 7, door 22 is rectangular in shape with a pair of brackets 24 and 26 mounted on upper and lower corners along one side, in this case, the right side of door 22. Brackets 24 and 26 are of metal construction, held in place by any suitable means, such as bolts or screws 28, and each one is provided with a pin 32 and 34, respectively, about which door 22 is able to pivot open and close as will be described below.

As seen in FIGS. 3 and 10, door 22 is supported by holes or sockets 36 and 38 in roof **12*a* and floor 12*b* to accommodate pins 32 and 34, respectively, and at the same time permitting door 22 to be hinged for rotation. Sockets 36 and 38 are deep enough to accommodate limited vertical movement of door 22** for a purpose to be described below.

As seen also in FIGS. 4 and 9, mounted through door 22 adjacent the bottom, free end of said door 22 is a lock cylinder 42 to be turned by key 44 when inserted. On the inside of door 22, mounted on the end of lock barrel 46 which is rotated by key 44 is a tongue 48 attached at one end which extends horizontally to unlock door 12 as shown in FIG. 11A and extends vertically to lock door 12 as shown in FIG. 11B. Tongue 48 is elongated and flat in configuration.

As seen also in FIG. 4, extending down from roof **12*a* is an upper jamb 52 and extending up from floor 12*b* is a lower jamb 54 against which door 22 is flush when closed. Behind lower jamb 54 is a shoulder or ledge 56 whose top surface is lined up with tongue 48 for a purpose to be described below when door 22** is in the closed position.

In front of, spaced from, and parallel with upper jamb 52 is an extended projection 58 which extends down only enough to permit door 22 when in its lower position as seen in FIGS. 4 and 11A to clear projection 58 but not clear upper jamb 52. When door 22 is in its upper position when closed and locked, as illustrated in FIGS. 11B and 12B, door 22 can not clear projection 58 and can not be opened.

In the operation of door 22, when door 22 is open, tongue 48 is in its horizontal position as shown in FIGS. 12A and 13. When door 22 is swung closed, tongue 48 clears lower jamb 54 and the top of door 22 clears projection 58 until door 22 is resting against jambs 52 and 54. If not already done, key 44 is inserted into lock 42 and rotated so that tongue 48 comes in contact with the top surface of shoulder 36 as seen in FIG. 14. By continuing to rotate key 44 and lock barrel 46 tongue 48 will force door 22 to rise until tongue 48 is in the vertical position shown in FIG. 14. In this position, the upper end of door 22 is wedged between projection 58 and upper jamb 52 and tongue 48 is behind lower jamb 54 so that both the top and bottom edges of door 22 are secure against being pried open. With key 44 removed, door 22 is securely locked and can not be opened without the use of key 44.

To open door 22, key 44 is reinserted into lock 42 and turned to rotate tongue 48 until it is in its horizontal position, permitting door 22 to drop a sufficient distance so that its top will clear projection 58 and tongue 48 will clear lower jamb 54 permitting door 22 to be readily opened.

It is thus seen that with a single lock it is possible to lock and unlock both the bottom and top of door 22 simultaneously thereby rendering more convenient and efficient the ability to secure or gain access to jewelry case 10.

It is readily apparent from the above description that it is possible to add, without departing from the principles of this invention, additional barriers along the sides of door 22 in order to provide additional locations for securing the door against being pried open, and regardless of the number of locations only a single lock and key in a single motion will lock or unlock the door.

Such an arrangement is shown in FIG. 15 where is illustrated a jewelry case 110 consisting of a housing 112 which is rectangular in shape with an overhanging roof **112*a* and overlapping floor 112*b* as illustrated. The overhanging roof 112*a*, similar in construction to that shown in the embodiment of FIGS. 1–14, as well as the support for the jewelry within housing 12**, are not shown in order to more clearly show the features of this embodiment.

Housing 112 of transparent material is provided with a door 122 to permit access to the interior of housing 112. Door 122 is rectangular in shape with a pair of brackets 124 and 126 mounted on upper and lower corners along one side, to carry pins 132 and 134 to fit into upper and lower sockets in the roof and floor, respectively, as in the embodiment of FIGS. 1–14, to permit limited vertical movement of door 122.

Mounted through door 122 is a lock cylinder 142 to be turned by a key (not illustrated) from the outside of housing 112. On the inside of door 122 is a tongue 148 identical in construction and operation as tongue 48 previously described.

Extending down from roof **112*a* is an upper jamb 152 and extending up from floor 112 is a lower jamb 154 which door 122 is flush when closed. Behind jamb 154 is a shoulder or ledge 156 to accommodate tongue 148** in the same manner as previously described.

In front of, spaced from, and parallel with upper jamb 152 is an extended projection 158 which extends down only enough to permit door 122 when in its lower position to clear projection 158 but not clear upper jamb 152.

To provide for additional security along the side edges of door 112, there are provided on the exposed edge 162 of door 122 one or more hooks 164 mounted on the inner surface of the door adjacent edge 162 each having a prong 166 extending upwardly.

On the inside of housing 112 adjacent edge 168 forming the opening for door 122 are located on or more members 172 extending past edge 168 into the door opening. Members 172 are situated so that when door 122 is closed, the upper tips of prongs 166 clear members 172, and when door 122 is raised as a result of the rotation of tongue 148 as previously described, prongs 166 will be raised so that they will be directly behind members 172 thereby preventing any prying open of door 122 in the regions of hooks 164.

In a similar fashion, the opposite edge of door 122 may be provided with a similar arrangement. Illustrated in FIG. 15 are hooks 174 with downwardly directed prongs 176 on the inside of the housing wall 178 while the extended members 182 are located on door 122, indicating that hooks and members can be reversed.

Thus, when door 122 is locked shut by a key causing tongue 148 to be rotated downwardly, door 122 will be raised and locked in a tamper proof fashion on all four sides.

While only certain preferred embodiments of this invention have been described it is understood that many variations of this invention are possible without departing from the principles of this invention. For example, instead of using a lock with a tongue as described in the preferred embodiments, other types of locks may be employed, such as drawer locks, cabinet locks, and cam locks.

Thus the invention is not to be limited to the embodiments described above but by the claims which follow.

What is claimed is:

1. A display case comprising:

a. a housing of transparent material having one or more vertically extending walls for viewing the interior of said housing;

b. means within said housing for mounting items for viewing from the outside of said housing;

c. a section of said wall forming an opening for a door having hinge means on one vertical edge of said door to permit said door to open and close;

d. said housing have a roof and a floor attached to and extending over and under said wall for fully enclosing said housing;

e. upper and lower jamb means extending down from and up from said roof and floor, respectively, for making contact with said door when shut;

f. projection means extending down from said roof spaced outwardly of said upper jam a sufficient distance to accommodate the thickness of said door but not extending down as far as said upper jamb;

g. means in sad roof and floor for accommodating said hinge means to permit said door to swing open and shut and at the same time permitting said door limited vertical movement between (i) a down position where the bottom edge of said door just clears said floor and the upper edge of said door just clears said projection means and (ii) an up position where said door will not clear said projection means;

h. ledge means adjacent said lower jamb on the inside of said housing having a top surface below the upper edge of said lower jamb;

i. lock means capable of being turned by a key extending through said door adjacent both the bottom and free edge of said door;

j. tongue means attached to said lock means on the inside of said door, said tongue means being attached at one end and having a free extended end for being urged by said lock means in a plane parallel with said door and lined up with the upper surface of said ledge means, said free extended end of said tongue means being of sufficient length that when urged into a downwardly extended orientation will come into contact with the upper edge of said ledge means and raise said door so that the upper edge of said door will become wedged between said projection means and said upper jamb, said lock means being located so that when said tongue means is in a horizontal orientation said door will drop to said down position and said free extended end of said tongue means will clear said lower jamb, permitting said door to be opened, thereby permitting a single lock to secure simultaneously said door against being pried open at both the top and bottom of said door.

2. The display case of claim 1 in which said housing is multi-faceted being made up of a plurality of flat walls, one of said walls accommodating said door.

3. The display case of claim 1 in which said tongue means comprises a flat, extended member.

4. The display case of claim 1 in which said housing is mounted on a pedestal for rotation.

5. The display case of claim 1 in which said hinge means comprises brackets on the top and bottom corners of said vertical edge of said door with pins extending upwardly and downwardly, respectively.

6. The display case of claim 5 in which said roof and floor incorporates sockets for said pins, said sockets being deep enough to permit said limited movement of said door.

7. The display case of claim 1 having engagement means along a vertical edge of said door to interlock with a portion of a section of said wall adjacent the opening for said door when said door is locked in its closed position.

8. The display case of claim 7 in which said portion of said wall includes means mounted on the inside of said wall to become engaged with said engagement means on said door.

9. The display case of claim 8 wherein one of said mounted means or said engagement means comprises a hook with an extended prong and the other of said mounted means of said engagement means comprises a horizontally extending member for being trapped by said prong.

10. The display case of claim 7 in which said engagement means are located along both vertical edges of said door.

* * * * *